US009003952B2

(12) United States Patent
Mori et al.

(10) Patent No.: US 9,003,952 B2
(45) Date of Patent: Apr. 14, 2015

(54) SWASH PLATE TYPE LIQUID-PRESSURE ROTATING DEVICE

(75) Inventors: Takashi Mori, Kobe (JP); Hideki Tamashima, Himeji (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 1049 days.

(21) Appl. No.: 13/054,455

(22) PCT Filed: Mar. 13, 2009

(86) PCT No.: PCT/JP2009/001127

§ 371 (c)(1),
(2), (4) Date: Jan. 27, 2011

(87) PCT Pub. No.: WO2010/007710

PCT Pub. Date: Jan. 21, 2010

(65) Prior Publication Data

US 2011/0113954 A1 May 19, 2011

(30) Foreign Application Priority Data

Jul. 16, 2008 (JP) ..... 2008-185335

(51) Int. Cl.
*F04B 1/12* (2006.01)
*F04B 1/20* (2006.01)
*F04B 1/32* (2006.01)

(52) U.S. Cl.
CPC ..... *F04B 1/128* (2013.01); *F04B 1/2014* (2013.01); *F04B 1/2085* (2013.01); *F04B 1/324* (2013.01); *F05C 2251/10* (2013.01); *F05C 2253/24* (2013.01)

(58) Field of Classification Search
USPC ..... 92/12.1, 12.2, 13, 158, 159, 160; 417/269; 148/565, 525, 639, 903; 91/505, 506, 507
See application file for complete search history.

(56) References Cited

U.S. PATENT DOCUMENTS 837,680 A * 12/1906 Goehns ..... 184/6.5
5,273,403 A * 12/1993 Im et al. ..... 417/213

(Continued)

FOREIGN PATENT DOCUMENTS

GB 2164358 A * 3/1986
JP 61008446 A * 1/1986

(Continued)

OTHER PUBLICATIONS

English translation of JP 2006-6291879 received on Oct. 28, 2013.*

(Continued)

*Primary Examiner* — Edward Look
*Assistant Examiner* — Michael Quandt
(74) *Attorney, Agent, or Firm* — Alleman Hall McCoy Russell & Tuttle LLP

(57) ABSTRACT

To improve productivity and increase seizing resistance and abrasion resistance of a sliding surface of a tilt adjustment cylinder, a plurality of pistons are arranged cirumferentially in a cylinder block configured to rotate with a rotating shaft. Tip end portions of the pistons slide along the swash plate, and the pistons reciprocate. The swash plate is supported to tilt with respect to the rotating shaft. Further, a tilt adjustment driving portion is included. The tilt adjustment driving portion includes tilt adjustment large- and small-diameter cylinder chambers and tilt adjustment large- and small-diameter pistons configured to slide in the cylinder chambers to change the tilt angle of the swash plate. A sliding surface of the inner peripheral surface of each of the cylinder chambers includes a quenched portion formed by quenching using laser light, the sliding surface being a surface on which the tilt adjustment piston slides.

5 Claims, 4 Drawing Sheets

(56) References Cited

U.S. PATENT DOCUMENTS

| | | | | |
|---|---|---|---|---|
| 5,827,588 | A * | 10/1998 | Snyder et al. | 428/36.9 |
| 7,814,823 | B2 * | 10/2010 | Takahashi et al. | 91/505 |
| 2008/0184878 | A1 * | 8/2008 | Chen et al. | 92/159 |

FOREIGN PATENT DOCUMENTS

| | | | | |
|---|---|---|---|---|
| JP | 61-058950 | A | | 3/1986 |
| JP | 62107024 | A | * | 5/1987 |
| JP | 63140849 | A | * | 6/1988 |
| JP | 63280961 | A | * | 11/1988 |
| JP | 01-306526 | A | | 12/1989 |
| JP | H0621295 | B2 | * | 3/1994 |
| JP | H0641791 | B2 | * | 6/1994 |
| JP | 2617451 | B2 | * | 6/1997 |
| JP | 2747746 | B2 | * | 5/1998 |
| JP | 11-050951 | A | | 2/1999 |
| JP | 2006-291879 | A | | 10/2006 |
| JP | 2007-092707 | A | | 4/2007 |

OTHER PUBLICATIONS

JPH0621295B2—English machine translation. 1994.*
JPH0641791B2—English machine translation. 1994.*
JP2747746B2—English machine translation. 1998.*
JP2617451B2 Machine translation to English. From espacenet.com. 1997.*
ISA Japanese Patent Office, International Search Report of PCT/JP2009/001127, Jun. 16, 2009, 2 pages.

* cited by examiner (a)

(b)

SWASH PLATE TYPE LIQUID-PRESSURE ROTATING DEVICE

TECHNICAL FIELD

The present invention relates to a swash plate type liquid-pressure rotating device which is used as a liquid-pressure motor or a liquid-pressure pump and is configured such that a swash plate is supported by a swash plate supporting portion so as to be able to tilt with respect to a rotating shaft and a tilt angle of the swash plate is controlled by a tilt adjustment driving portion.

BACKGROUND ART

Generally, in a swash plate type piston pump, a back surface (convex surface) of a swash plate projects in a circular-arc shape, a circular-arc supporting surface (concave surface) is formed on a swash plate supporting portion, and the projecting circular-arc back surface of the swash plate is supported by the supporting surface so as to be able to tilt. A tilt angle of the swash plate with respect to a rotating shaft can be changed by tilting the swash plate. With this, the amount of discharged hydraulic oil can be adjusted (see Patent Document 1 for example).

Specifically, this piston pump is configured such that a plurality of pistons are included in a cylinder block provided in a casing to be arranged in a circumferential direction, and the cylinder block rotates in accordance with the rotation of the rotating shaft. By the rotation of the cylinder block, the piston reciprocates while a tip end portion thereof is guided along the swash plate. Thus, the piston can suck and discharge the hydraulic oil. Here, if the tilt angle of the swash plate is increased, a stroke of the piston increases, and this increases the amount of discharged hydraulic oil. In contrast, if the tilt angle is decreased, the stroke of the piston decreases, and this decreases the amount of discharged hydraulic oil.

In order to increase or decrease the tilt angle of the swash plate, a tilt adjustment driving portion is provided. The tilt adjustment driving portion includes a tilt adjustment cylinder and a tilt adjustment piston configured to slide in the tilt adjustment cylinder to change the tilt angle of the swash plate.

The tilt adjustment driving portion can change the position of the tilt adjustment piston in response to a control command from a mounting apparatus to change the tilt angle of the swash plate. Therefore, during the operation of the swash plate type piston pump, the tilt adjustment piston slides back and forth at all times in order to control the amount of discharged hydraulic oil at all times in accordance with, for example, the amount of hydraulic oil used by the apparatus. Similarly, during the operation of the swash plate type piston pump as a motor, the tilt adjustment piston slides back and forth at all times in order for the number of rotations of the rotating shaft to be controlled to the number changed in response to the command from the mounting apparatus, for example.

Depending on a positional relation between the tilt adjustment piston of the tilt adjustment driving portion and the swash plate, a component force (lateral component force) may be applied to the tilt adjustment piston in a direction perpendicular to an axial direction of the tilt adjustment piston. With this, the tilt adjustment piston may slide back and forth while applying a high surface pressure to an inner surface of the tilt adjustment cylinder. In this case, a lubricating oil film at an interface between the tilt adjustment cylinder and the tilt adjustment piston tends to be cut. Therefore, each of a sliding surface of the tilt adjustment cylinder and a sliding surface of the tilt adjustment piston requires seizing resistance and abrasion resistance.

Conventionally, the tilt adjustment cylinder made of cast iron is subjected to gas nitrocarburizing for hardening the surface thereof by causing nitrogen to diffusively intrude or infiltrate into the cast iron. Thus, the seizing resistance and the abrasion resistance are given to the tilt adjustment cylinder.

Patent Document 1: Japanese Laid-Open Patent Application Publication No. 11-50951

DISCLOSURE OF THE INVENTION

Problems to be Solved by the Invention

The seizing resistance and the abrasion resistance may be given to only a sliding surface of the tilt adjustment cylinder, the sliding surface being a surface on which the tilt adjustment piston slides. However, in the case of carrying out a surface treatment by the gas nitrocarburizing, the whole parts are subjected to the gas nitrocarburizing, so that large-scale equipment is required for mass production. In addition, since the whole parts are heated at high temperature (about 570° C.) in the gas nitrocarburizing, they need to be subjected to annealing for stress relieve before the gas nitrocarburizing to prevent heat deformation. Further, since a plurality of parts are subjected to batch processing at one time in the gas nitrocarburizing in consideration of work efficiency, a production lead time may become long. Therefore, it is difficult to carry out the gas nitrocarburizing on a production line of the piston pump. Furthermore, since the gas nitrocarburizing becomes unstable if the surfaces of the parts are not cleaned to some extent, preliminary washing of the parts is required.

The present invention was made to solve the above problems, and an object of the present invention is to provide a swash plate type liquid-pressure rotating device capable of improving productivity and increasing the seizing resistance and abrasion resistance of the sliding surface of the tilt adjustment cylinder.

Means for Solving the Problems

A swash plate type liquid-pressure rotating device according to the present invention is a swash plate type liquid-pressure rotating device in which: a plurality of pistons are arranged in a circumferential direction in a cylinder block configured to rotate with a rotating shaft; tip end portions of the pistons slide along a surface of a swash plate and the pistons reciprocate; the swash plate is supported by a swash plate supporting portion so as to be able to tilt with respect to the rotating shaft; and a tilt adjustment driving portion configured to change a tilt angle of the swash plate is included, wherein: the tilt adjustment driving portion includes a tilt adjustment cylinder and a tilt adjustment piston configured to slide in the tilt adjustment cylinder to change the tilt angle of the swash plate; and a sliding surface of an inner surface of the tilt adjustment cylinder includes a quenched portion formed by partially quenching the sliding surface using laser light, the sliding surface being a surface on which the tilt adjustment piston slides.

In accordance with the swash plate type liquid-pressure rotating device of the present invention, the quenched portions partially formed by utilizing high directivity of the laser light become convex by heat expansion, so that the quenched portions and the non-quenched portions can form concave portions and convex portions. With this, a contact property and a sliding property between the tilt adjustment cylinder and the tilt adjustment piston improve, and this can increase the seizing resistance. In addition, only the sliding surface of the inner surface of the tilt adjustment cylinder may be quenched by the laser light, the sliding surface being a surface on which the tilt adjustment piston slides. Therefore, the abrasion resistance can be given to the sliding surface by comparatively small equipment in a short period of time. Further, since selective quenching whose case depth is shallow can be carried out, heat deformation is unlikely to occur, so that finishing processing can be omitted. Moreover, since laser quenching can be carried out in the atmosphere and does not require a cooling liquid, a clean working environment can be provided. Since the surface to be quenched only has to have a certain absorption ratio of the laser light, it is unnecessary to pay too much attention to cleanliness of surfaces of parts as in the case of the gas nitrocarburizing. Therefore, inline processing can be carried out in a production line of the swash plate type liquid-pressure rotating device. Thus, the productivity can be significantly improved, and the seizing resistance and abrasion resistance of the sliding surface of the tilt adjustment cylinder can be increased.

Then, in the swash plate type liquid-pressure rotating device according to the present invention, the quenched portion may be formed in an annular shape about a shaft center of the tilt adjustment cylinder, and a gap which is not subjected to quenching may be formed at a part of the quenched portion, and a size of the gap may be set to such a size that does not reduce an effect of the quenching of each of end portions of the quenched portion or be set to a size lager than the above size, the end portions being opposed to each other with the gap therebetween.

As above, in a case where the annular quenched portion is formed by the laser light such that the quenching start portion and the quenching termination portion do not overlap each other, the hardness of each of the quenching start portion and the quenching termination portion by the quenching can be maintained, so that the required seizing resistance and abrasion resistance can be secured. Moreover, the sealing performance of the gap can be improved by carrying out the quenching such that the gap is reduced in size while each of the quenching start portion and the quenching termination portion is formed so as to obtain the required hardness.

To be specific, in a case where the quenching start portion and the quenching termination portion overlap each other, this overlapping portion may be annealed, and this may decrease the hardness thereof. Further, the quenched portion becomes convex by the expansion caused by the structural transformation caused by the quenching. Here, since the overlapping portion where the quenching start portion and the quenching termination portion overlap each other is subjected to the quenching twice, the degree of the convex varies. This variation of the degree of the convex at the overlapping portion becomes a factor of disturbing smooth slide movement of the tilt adjustment piston.

By forming the annular quenched portion on a surface perpendicular to the shaft center of the tilt adjustment cylinder, slide resistance generated by the quenched portion when the tilt adjustment piston slides in the tilt adjustment cylinder is substantially uniformly applied to respective positions on an outer peripheral surface of the tilt adjustment piston. Therefore, the tilt adjustment piston can slide while being prevented from causing one-side hitting with respect to the tilt adjustment cylinder.

Moreover, in the swash plate type liquid-pressure rotating device according to the present invention, the quenched portion may be one of a plurality of quenched portions arranged in a direction along a shaft center of the tilt adjustment cylinder at predetermined intervals, and a non-quenched portion existing between the adjacent quenched portions may form an annular groove portion.

With this, an annular groove portion that is the non-quenched portion can be formed between two annular projections that are the quenched portions, and these two quenched portions and one non-quenched portion can hold the lubricating oil without leaking. With this, an oil film can be formed at an entire interface between the tilt adjustment cylinder and the tilt adjustment piston. As a result, even when the tilt adjustment piston causes one-side hitting with respect to the tilt adjustment cylinder by a lateral component force generated by the relation with the swash plate, it is possible to prevent the oil film from being cut over the entire inner peripheral surface of the tilt adjustment cylinder. Thus, the tilt adjustment piston can smoothly slide in the tilt adjustment cylinder.

Further, in the swash plate type liquid-pressure rotating device according to the present invention, the gap of one of the adjacent annular quenched portions and the gap of the other quenched portion may be separated from each other at about 90° in a circumferential direction of the quenched portion.

With this, the gaps of the adjacent annular quenched portions are separated from each other at about 90° or larger in the circumferential direction of the quenched portion. Thus, a leakage distance of each of lubricating oil and hydraulic liquid can be increased, so that the lubricating oil and the hydraulic liquid can be prevented from leaking.

Then, in the swash plate type liquid-pressure rotating device according to the present invention, the quenched portion may be formed in a spiral shape about a shaft center of the tilt adjustment cylinder, and an interval between adjacent circular portions of the spiral quenched portion may be set to such a size that does not reduce an effect of the quenching or be set to a size larger than the above size.

By forming the quenched portion in the spiral shape, a time in which the quenching by the laser light can be continuously carried out can be increased, so that the quenching can be efficiently carried out. Then, the lubricating oil can be stored in a spiral groove portion that is the non-quenched portion formed between the quenched portions. Further, since a distance between both end openings of the spiral groove portion can be increased, the leakage distance of each of the lubricating oil and the hydraulic liquid can be comparatively increased. Then, the interval between the adjacent circular portions of the spiral quenched portion is set to such a size that does not reduce the effect of the quenching or is set to a size larger than the above size, so that the predetermined quenching effect can be obtained. Other than the above, this operates in the same manner as the above invention.

Moreover, in the swash plate type liquid-pressure rotating device according to the present invention, an area ratio of the quenched portion with respect to a sliding surface of an inner surface of the tilt adjustment cylinder may be 50% to 90%, the sliding surface being a surface on which the tilt adjustment piston slides.

The area ratio of the quenched portion to the sliding surface is set to 50% to 90%, so that practical seizing resistance and abrasion resistance can be secured, and a practical amount of lubricating oil can be stored in the groove portion that is the non-quenched portion. In a case where the area ratio of the quenched portion is lower than 50%, it is difficult to secure practical seizing resistance and abrasion resistance. In a case where the area ratio of the quenched portion exceeds 90%, it is difficult to store a practical amount of lubricating oil.

Moreover, the swash plate type liquid-pressure rotating device according to the present invention may be used as a motor or a pump. For example, the swash plate type liquid-pressure rotating device of the present invention may be used as a liquid-pressure motor or pump, such as an oil-pressure motor or pump.

Effect of the Invention

The swash plate type liquid-pressure rotating device according to the present invention is configured such that the sliding surface of the inner surface of the tilt adjustment cylinder is partially quenched by laser light to form the quenched portion, the sliding surface being a surface on which the tilt adjustment piston slides. Therefore, the productivity of the swash plate type liquid-pressure rotating device can be significantly improved, and the seizing resistance and abrasion resistance of the sliding surface of the tilt adjustment cylinder can be increased.

BRIEF DESCRIPTION OF THE DRAWINGS

FIG. 2(*b*) is a perspective view showing the quenched portion formed on a tilt adjustment small-diameter cylinder chamber included in the swash plate type liquid-pressure rotating device according to Embodiment 1.

FIG. 3(*b*) is a perspective view schematically showing the quenched portion formed on each of the tilt adjustment large-diameter cylinder chamber and tilt adjustment small-diameter cylinder chamber included in the swash plate type liquid-pressure rotating device according to Embodiment 3 of the present invention.

EXPLANATION OF REFERENCE NUMBERS

Figure 1:
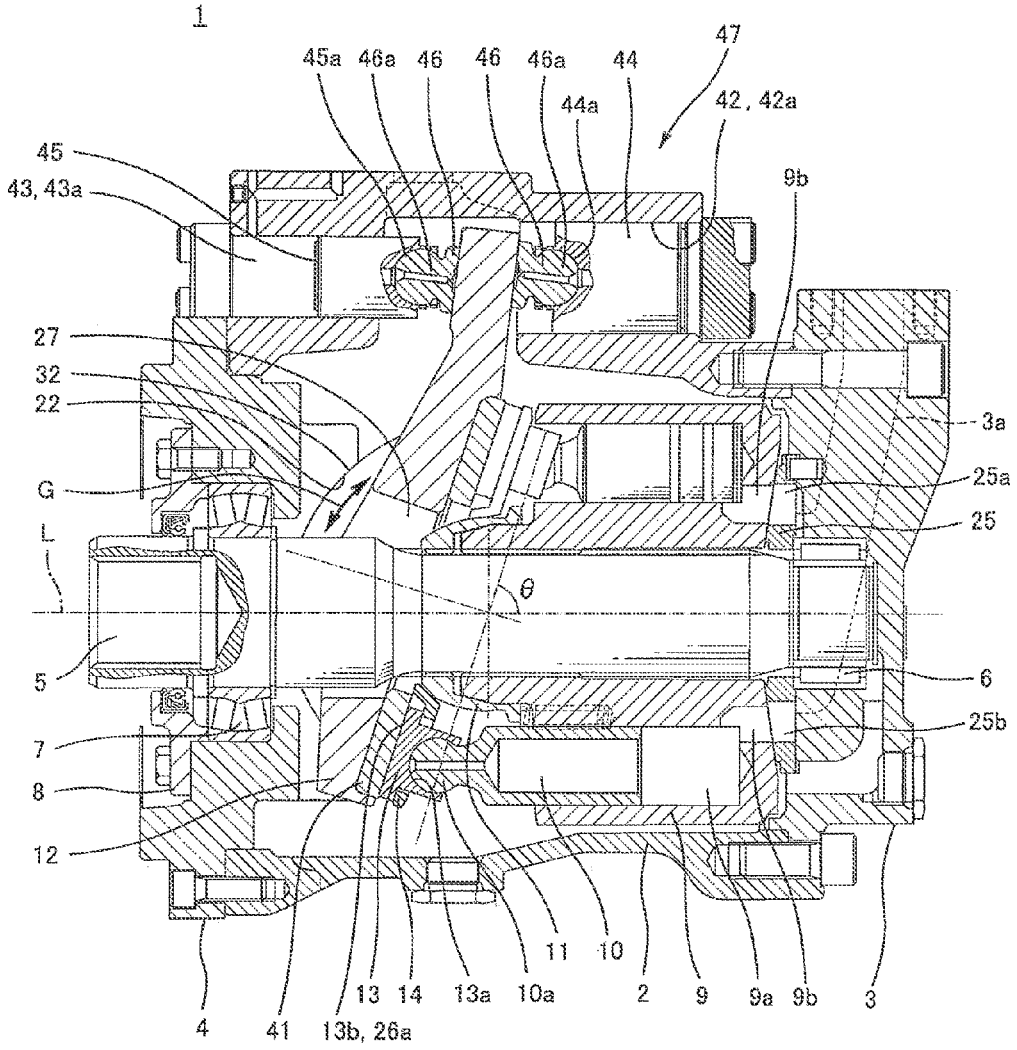
FIG. 1 is a longitudinal sectional view showing a swash plate type liquid-pressure rotating device according to Embodiment 1 of the present invention.

1 swash plate type liquid-pressure rotating device
2 casing main body
3 valve cover
3*a* supply passage
4 swash plate supporting portion
5 rotating shaft
6, 7 bearing
8 sealing cover
9 cylinder block
9*a* piston chamber
9*b* oil passage
10 piston
10*a* tip end portion
11 receiving seat
12 swash plate
13 shoe
13*a* fit recess
13*b* contact surface
14 retainer plate
22 concave surface
25 valve plate
25*a* supply port
25*b* discharge port
26*a* smooth surface
27 through hole
32 convex surface
41 shoe plate
42 tilt adjustment large-diameter cylinder chamber
42*a* inner peripheral surface
43 tilt adjustment small-diameter cylinder chamber
43*a* inner peripheral surface
44 tilt adjustment large-diameter piston
44*a* fit recess
45 tilt adjustment small-diameter piston
45*a* fit recess
46 tilt adjustment shoe
46*a* end portion
47 tilt adjustment driving portion
48 quenched portion
48*a*, 48*b* end portion
49 non-quenched portion
50 gap
51 oil hole
53 quenched portion
54, 55 opening
L rotating axis

Best Mode for Carrying out the Invention

Hereinafter, Embodiment 1 of a swash plate type liquid-pressure rotating device according to the present invention will be explained in reference to FIGS. 1, 2, and 4. A swash plate type liquid-pressure rotating device 1 may be used as an oil-pressure motor, an oil-pressure pump, or the like. Embodiment 1 will explain an example in which the swash plate type liquid-pressure rotating device 1 is used as the oil-pressure motor.

FIG. 1 is a longitudinal sectional view showing the swash plate type liquid-pressure rotating device 1 according to Embodiment 1. As shown in FIG. 1, the swash plate type liquid-pressure rotating device 1 includes a substantially tubular casing main body 2. A right opening of the casing main body 2 is closed by a valve cover 3. The valve cover 3 includes a supply passage 3*a* and a discharge passage (not shown). A left opening of the casing main body 2 is closed by a swash plate supporting portion 4.

A rotating shaft (driving shaft) 5 is provided in the casing main body 2 to extend substantially horizontally in a left-right direction. The rotating shaft 5 is rotatably provided at the valve cover 3 and the swash plate supporting portion 4 via bearings 6 and 7. The bearing 7 internally fits the swash plate supporting portion 4. A sealing cover 8 is attached to an outer side of the bearing 7.

A cylinder block 9 is splined to the rotating shaft 5 and rotates integrally with the rotating shaft 5.

A plurality of piston chambers 9*a* are concavely formed on the cylinder block 9 so as to be arranged at regular intervals in a circumferential direction about a rotating axis L of the rotating shaft 5. Each of the piston chambers 9*a* is formed in parallel with the rotating axis L and stores a piston 10 therein.

A tip end portion 10*a* of the piston 10 projecting from the piston chamber 9*a* is spherical and is rotatably attached to a fit recess 13*a* of a shoe 13. Moreover, a receiving seat 11 of the shoe 13 externally fits a left tip end of the cylinder block 9. The receiving seat 11 is a spherical bush.

Moreover, a swash plate 12 is disposed on a contact surface 13*b* of the shoe 13 via a shoe plate 41, the contact surface 13*b* being located on an opposite side of the fit recess 13*a*. The shoe 13 is pressed toward the swash plate 12 side by causing a retainer plate 14 to fit the shoe 13 from the cylinder block 9 side.

The shoe plate 41 includes a smooth surface 26*a* contacting the contact surface 13*b* of the shoe 13. When the cylinder block 9 rotates, the shoe 13 is guided along the smooth surface 26*a* to rotate, and the pistons 10 reciprocate in a direction along the rotating axis L.

A circular-arc convex surface 32 is formed on a surface of the swash plate 12, the surface being opposite to the shoe plate 41, and the convex surface 32 is slidably supported by a circular-arc concave surface 22 of the swash plate supporting portion 4. Moreover, a through hole 27 through which the rotating shaft 5 is inserted is formed on the swash plate 12.

Further, as shown in FIG. 1, a valve plate 25 which slides on the cylinder block 9 is attached to an inner surface side of the valve cover 3. The valve plate 25 includes a supply port 25*a* and a discharge port 25*b*. An oil passage 9*b* communicated with the piston chamber 9*a* of the cylinder block 9 is communicated with the supply port 25*a* or the discharge port 25*b* depending on a rotation angular position of the cylinder block 9. The valve cover 3 includes: the supply passage 3*a* which is communicated with the supply port 25*a* of the valve plate 25 and opens on an outer surface of the valve cover 3; and the discharge passage (not shown) which is communicated with the discharge port 25*b* and opens on the outer surface of the valve cover 3.

Moreover, as shown in FIG. 1, a tilt adjustment driving portion 47 is provided at an upper portion of the casing main body 2. The tilt adjustment driving portion 47 includes a tilt adjustment large-diameter cylinder chamber (hereinafter may be simply referred to as a "large-diameter cylinder chamber") 42 and a tilt adjustment small-diameter cylinder chamber (hereinafter may be simply referred to as a "small-diameter cylinder chamber") 43. The large-diameter cylinder chamber 42 and the small-diameter cylinder chamber 43 are coaxially provided to be opposed to each other in the left-right direction. The large-diameter cylinder chamber 42 accommodates a tilt adjustment large-diameter piston (hereinafter may be simply referred to as a "large-diameter piston") 44, and the small-diameter cylinder chamber 43 accommodates a tilt adjustment small-diameter piston (hereinafter may be simply referred to as a "small-diameter piston") 45.

A tilt adjustment shoe 46 is attached to an end portion of the large-diameter piston 44, the end portion being located on the swash plate 12 side. The large-diameter piston 44 contacts one of contact surfaces of an upper portion of the swash plate 12 via the tilt adjustment shoe 46.

The tilt adjustment shoe 46 has a spherical end portion 46*a* which is attached to the large-diameter piston 44. The spherical end portion 46*a* is rotatably attached to a fit recess 44*a* formed at the end portion of the large-diameter piston 44. An end portion of the tilt adjustment shoe 46 which portion contacts the swash plate 12 is formed as a flat surface, and the flat surface realizes surface contact with one of the contact surfaces of the upper portion of the swash plate 12.

Similarly, another tilt adjustment shoe 46 is attached to an end portion of the tilt adjustment small-diameter piston 45, the end portion being located on the swash plate 12 side. The tilt adjustment small-diameter piston 45 contacts the other contact surface of the upper portion of the swash plate 12 via the tilt adjustment shoe 46.

The tilt adjustment shoe 46 has a spherical end portion 46*a* which is attached to the tilt adjustment small-diameter piston 45. The spherical end portion 46*a* is rotatably attached to a fit recess 45*a* formed at the end portion of the tilt adjustment small-diameter piston 45. An end portion of the tilt adjustment shoe 46 which portion contacts the swash plate 12 is formed as a flat surface, and the flat surface realizes the surface contact with the other contact surface of the upper portion of the swash plate 12.

In accordance with the tilt adjustment driving portion 47, for example, by increasing or decreasing the pressure of hydraulic oil supplied to the large-diameter cylinder chamber 42 by a regulator (not shown) in a state where the normal-pressure hydraulic oil is supplied to the small-diameter cylinder chamber 43, the tilt adjustment large-diameter piston 44 and the tilt adjustment small-diameter piston 45 can be caused to slide in a desired left-right direction by a desired distance. Thus, a tilt angle θ of the swash plate 12 with respect to the rotating axis L can be changed. At this time, the convex surface 32 of the swash plate 12 is guided by the concave surface 22 of the swash plate supporting portion 4, so that the swash plate 12 rotates about a predetermined shaft center in an elevation-angle direction G shown in FIG. 1.

In accordance with these tilt adjustment shoes 46, when the tilt adjustment large-diameter piston 44 and the tilt adjustment small-diameter piston 45 slide in the left-right direction, the tilt adjustment shoes 46 respectively rotate in the fit recesses 44*a* and 45*a*, so that the end portions of the tilt adjustment shoes 46 respectively maintain the surface contact with the contact surfaces of the swash plate 12. Therefore, the tilt adjustment large-diameter piston 44 and the tilt adjustment small-diameter piston 45 can slide while being prevented from causing one-side hitting with respect to the large-diameter cylinder chamber 42 and the small-diameter cylinder chamber 43, respectively.

Next, quenched portions 48 will be explained in reference to FIGS. 2(*a*) and 2(*b*). The quenched portions 48 are formed on each of an inner peripheral surface 42*a* of the large-diameter cylinder chamber 42 and an inner peripheral surface 43*a* of the small-diameter cylinder chamber 43 in the tilt adjustment driving portion 47. The casing main body 2 in which the large-diameter cylinder chamber 42 and the small-diameter cylinder chamber 43 are formed is made of, for example, cast iron.

First, the quenched portions 48 formed on the inner peripheral surface 42*a* of the large-diameter cylinder chamber 42 will be explained in reference to FIG. 2(*a*). A plurality of the quenched portions 48 are formed on a sliding surface of the inner peripheral surface 42*a* of the large-diameter cylinder chamber 42, the sliding surface being a surface on which the tilt adjustment large-diameter piston 44 slides.

The quenched portions 48 are formed in a stripe pattern by irradiating the sliding surface with laser light in a stripe pattern in a circumferential direction perpendicular to a sliding direction of the large-diameter piston 44 by using a laser irradiation device (not shown), such as a carbon dioxide laser, a YAG laser, a solid state laser, or a semiconductor laser. By this quenching, the quenched portions 48 become convex by expansion caused by structural transformation. Thus, the quenched portions 48 and non-quenched portions 49 form projections and depressions.

Figure 2:
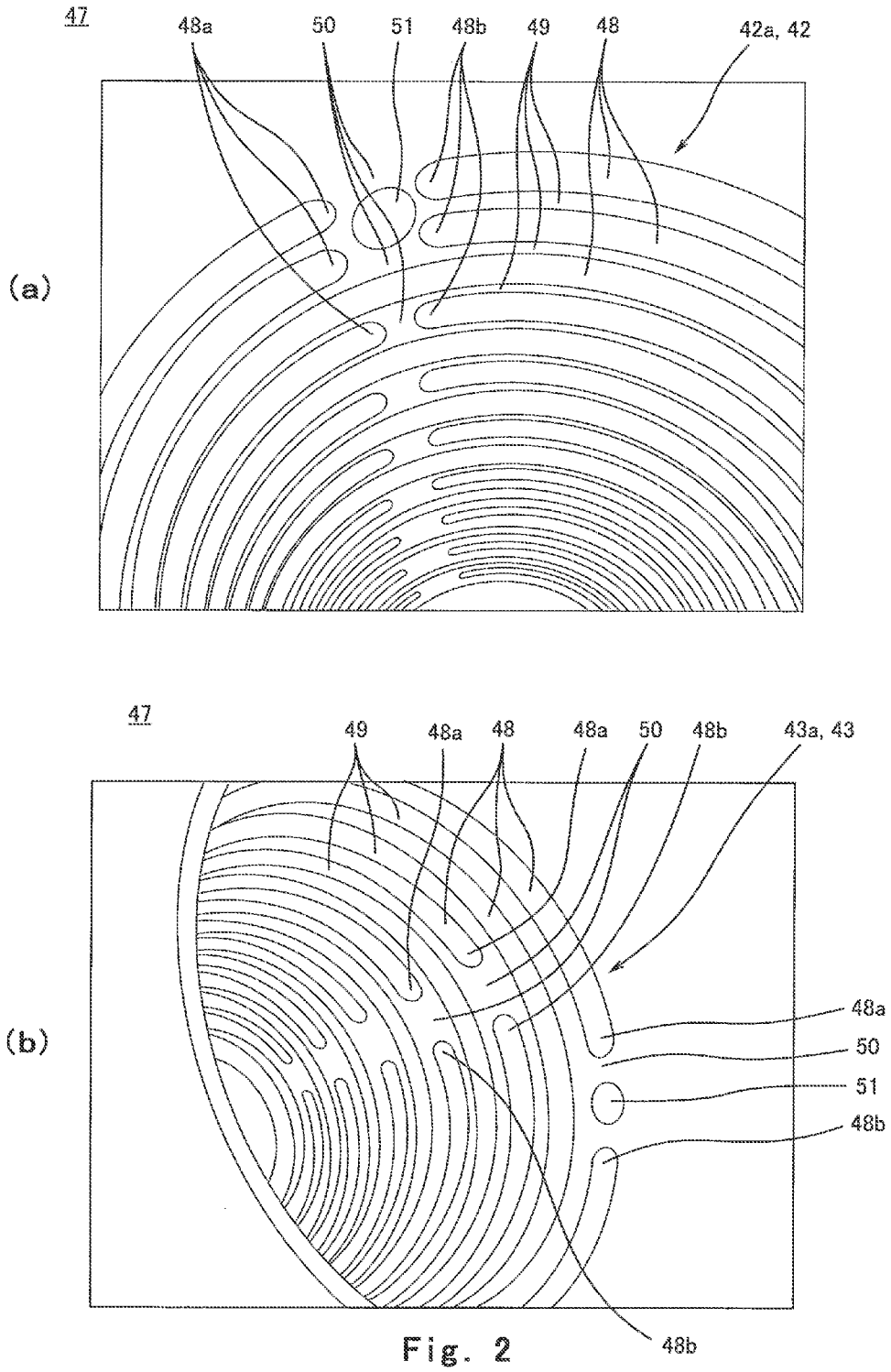
FIG. 2(*a*) is a perspective view showing a quenched portion formed on a tilt adjustment large-diameter cylinder chamber included in the swash plate type liquid-pressure rotating device according to Embodiment 1.

To be specific, as shown in FIG. 2(*a*), each of the quenched portions 48 is formed in an annular shape about a shaft center of the large-diameter cylinder chamber 42, and for example, one gap 50 which is not subjected to the quenching is formed at a part of the quenched portion 48. The size of the gap 50 is set to such a size that does not reduce an effect of the quenching of each of the end portions 48*a* and 48*b* of the quenched portion 48, the end portions 48*a* and 48*b* being opposed to each other with the gap 50 therebetween or is set to a size larger than the above size. Moreover, each of the annular quenched portions 48 is formed on a surface substantially perpendicular to the shaft center of the large-diameter cylinder chamber 42.

Further, a plurality of the quenched portions 48 are formed in a direction along the shaft center of the large-diameter cylinder chamber 42 at predetermined intervals (for example, each of the intervals is slightly narrower than a horizontal width of the quenched portion 48), and annular groove portions are formed by the non-quenched portions 49 each existing between the adjacent quenched portions 48.

The gap 50 of one of the adjacent annular quenched portions 48 and the gap 50 of the other quenched portion 48 are formed to be separated from each other at about 180° in the circumferential direction of the quenched portion 48.

As shown in FIG. 2(*a*), an oil hole 51 is formed on the inner peripheral surface 42*a* of the large-diameter cylinder chamber 42, and the quenched portion 48 is formed so as to avoid the oil hole 51. For example, the oil hole 51 is formed at the gap 50. The oil hole 51 is formed to supply lubricating oil to the large-diameter cylinder chamber 42.

Moreover, FIG. 2(*b*) shows the quenched portions 48 formed on the inner peripheral surface 43*a* of the small-diameter cylinder chamber 43. A large number of the quenched portions 48 formed on the inner peripheral surface 43*a* of the small-diameter cylinder chamber 43 are the same as a large number of the quenched portions 48 formed on the inner peripheral surface 42*a* of the large-diameter cylinder chamber 42, so that the same reference numbers are used for the same components, and explanations thereof are omitted.

Next, the operations of the swash plate type liquid-pressure rotating device 1 which is configured as above and used as, for example, an oil-pressure motor will be explained in reference to FIG. 1. First, when pressure oil that is the hydraulic oil is supplied through the supply passage 3*a* to the piston chamber 9*a*, the piston 10 is pushed out from the piston chamber 9*a* and guided by the swash plate 12 to move downward. With this, the rotating shaft 5 can be rotated in a predetermined direction. Then, the other piston 10 moves upward and is guided by the swash plate 12 to be pushed into the piston chamber 9*a*. With this, the hydraulic oil in the piston chamber 9*a* is discharged through the discharge passage. Thus, the rotating shaft 5 can be continuously rotated in the predetermined direction.

Moreover, in accordance with the tilt adjustment driving portion 47 shown in FIG. 1, the tilt angle θ of the swash plate 12 with respect to the rotating axis L can be changed by causing the tilt adjustment large-diameter piston 44 and the small-diameter piston 45 to slide in the left-right direction by the hydraulic oil. With this, the amount of stroke of the piston 10 can be changed, and a rotating speed of the rotating shaft 5 can be adjusted.

In the case of using the swash plate type liquid-pressure rotating device 1 as the oil-pressure pump, the rotating shaft 5 is rotated by a different rotation driving device, not shown. In this case, the cylinder block 9 rotates by the rotation of the rotating shaft 5, and the pistons 10 reciprocate while the tip end portions 10*a* thereof are being guided along the swash plate 12. With this, the hydraulic oil is sequentially discharged from the piston chambers 9*a*. Thus, the hydraulic oil can be discharged.

Next, the effects of the quenched portions 48 formed on the inner peripheral surface 42*a* of the large-diameter cylinder chamber 42 and the inner peripheral surface 43*a* of the small-diameter cylinder chamber 43 in the tilt adjustment driving portion 47 will be explained in reference to FIGS. 2(*a*) and 2(*b*). As above, the quenched portions 48 partially formed by utilizing high directivity of the laser light become convex by the expansion caused by the structural transformation. Therefore, the quenched portions 48 and the non-quenched portions 49 can form convex potions and concave portions, although not shown. With this, a contact property and a sliding property between the inner peripheral surface 42*a* of the large-diameter cylinder chamber 42 and the tilt adjustment large-diameter piston 44 and a contact property and a sliding property between the inner peripheral surface 43*a* of the small-diameter cylinder chamber 43 and the tilt adjustment small-diameter piston 45 improve, and this can increase the seizing resistance. A difference in height between the convex portion of the quenched portion 48 and the concave portion of the non-quenched portion 49 is, for example, 5 to 20 μm.

In addition, only the sliding surface of the inner peripheral surface 42*a* of the tilt adjustment large-diameter cylinder chamber 42 and the sliding surface of the inner peripheral surface 43*a* of the tilt adjustment small-diameter cylinder chamber 43 may be quenched by the laser light, the sliding surface being a surface on which the tilt adjustment large-diameter piston 44 or the tilt adjustment small-diameter piston 45 slides. Therefore, the abrasion resistance can be given to the sliding surface by comparatively small equipment in a short period of time. Further, since selective quenching whose case depth is shallow can be carried out, the heat deformation is unlikely to occur, so that finishing processing can be omitted. Moreover, since laser quenching can be carried out in the atmosphere and does not require a cooling liquid, a clean working environment can be provided. Since the surface to be quenched only has to have a certain absorption ratio of the laser light, it is unnecessary to pay too much attention to cleanliness of surfaces of parts as in the case of the gas nitrocarburizing. Therefore, inline processing can be carried out in a production line of the swash plate type liquid-pressure rotating device 1. Thus, the productivity can be significantly improved, and the seizing resistance and abrasion resistance of the sliding surface of each of the tilt adjustment large-diameter cylinder chamber 42 and the tilt adjustment small-diameter cylinder chamber 43 can be increased. The case depth of the quenched portion 48 is, for example, 0.2 to 0.5 mm. In a case where the case depth of the quenched portion 48 is less than 0.2 mm, the practical abrasion resistance is unlikely to be obtained. In a case where the case depth of the quenched portion 48 is more than 0.5 mm, the quenched surface becomes rough by heating, so that the sliding property required by the piston is unlikely to be obtained.

As shown in FIGS. 2(*a*) and 2(*b*), when the annular quenched portion 48 is formed by the laser light, the gap 50 is formed between a quenching start portion (end portion 48*a*, for example) and a quenching termination portion (end portion 48*b*, for example), so that the quenching start portion and the quenching termination portion do not overlap each other. With this, the hardness of each of the quenching start portion 48*a* and the quenching termination portion 48*b* by the quenching can be maintained, so that the required seizing resistance and abrasion resistance can be secured. Moreover, the sealing performance of the gap 50 can be improved by carrying out the quenching such that the gap 50 is reduced in size while each of the quenching start portion 48*a* and the quenching termination portion 48*b* is formed so as to obtain the required hardness.

To be specific, in a case where the quenching start portion 48*a* and the quenching termination portion 48*b* overlap each other, this overlapping portion may be annealed, and this may decrease the hardness thereof and the effect of the quenching.

Further, the quenched portion 48 becomes convex by the expansion caused by the structural transformation caused by the quenching. Here, since the overlapping portion where the quenching start portion 48*a* and the quenching termination portion 48*b* overlap each other is subjected to the quenching twice, the degree of the convex varies. This variation of the degree of the convex at the overlapping portion becomes a factor of disturbing smooth slide movement of each of the tilt adjustment large-diameter piston 44 and the tilt adjustment small-diameter piston 45.

By forming the annular quenched portions 48 on a surface perpendicular to the shaft center of each of the large-diameter cylinder chamber 42 and the small-diameter cylinder chamber 43, slide resistance generated by the quenched portions 48 when the tilt adjustment large-diameter piston 44 and the tilt adjustment small-diameter piston 45 respectively slide in the tilt adjustment large-diameter cylinder chamber 42 and the tilt adjustment small-diameter cylinder chamber 43 is substantially uniformly applied to respective positions on an outer peripheral surface of each of the large-diameter piston 44 and the small-diameter piston 45. Therefore, the large-diameter piston 44 and the small-diameter piston 45 can slide while being prevented from causing one-side hitting with respect to the large-diameter cylinder chamber 42 and the small-diameter cylinder chamber 43, respectively.

Moreover, as shown in FIGS. 2(*a*) and 2(*b*), in a case where one annular groove portion that is the non-quenched portion 49 is formed between two annular projections that are the quenched portions 48, these two quenched portions 48 and one non-quenched portion 49 can hold the lubricating oil without leaking. With this, an oil film can be formed at each of an entire interface between the large-diameter cylinder chamber 42 and the large-diameter piston 44 and an entire interface between the small-diameter cylinder chamber 43 and the small-diameter piston 45. As a result, even when the large-diameter piston 44 and the small-diameter piston 45 cause one-side hitting with respect to the inner peripheral surface 42*a* of the large-diameter cylinder chamber 42 and the inner peripheral surface 43*a* of the small-diameter cylinder chamber 43, respectively, by a lateral component force generated by the relation with the swash plate 12, it is possible to prevent the oil film from being cut over the entire inner peripheral surface 42*a* of the large-diameter cylinder chamber 42 and the entire inner peripheral surface 43*a* of the small-diameter cylinder chamber 43. Thus, the large-diameter piston 44 and the small-diameter piston 45 can smoothly slide in the large-diameter cylinder chamber 42 and the small-diameter cylinder chamber 43, respectively.

Here, a horizontal width of the non-quenched portion 49 is set to such a size that does not reduce the effect of the quenching of each of the adjacent quenched portions 48.

Further, as shown in FIGS. 2(*a*) and 2(*b*), the gaps 50 of the adjacent annular quenched portions 48 are separated from each other at about 180° in the circumferential direction of the quenched portion 48. With this, a leakage distance of the lubricating oil and the hydraulic oil can be comparatively increased, so that the lubricating oil and the hydraulic oil can be prevented from leaking.

Figure 3:
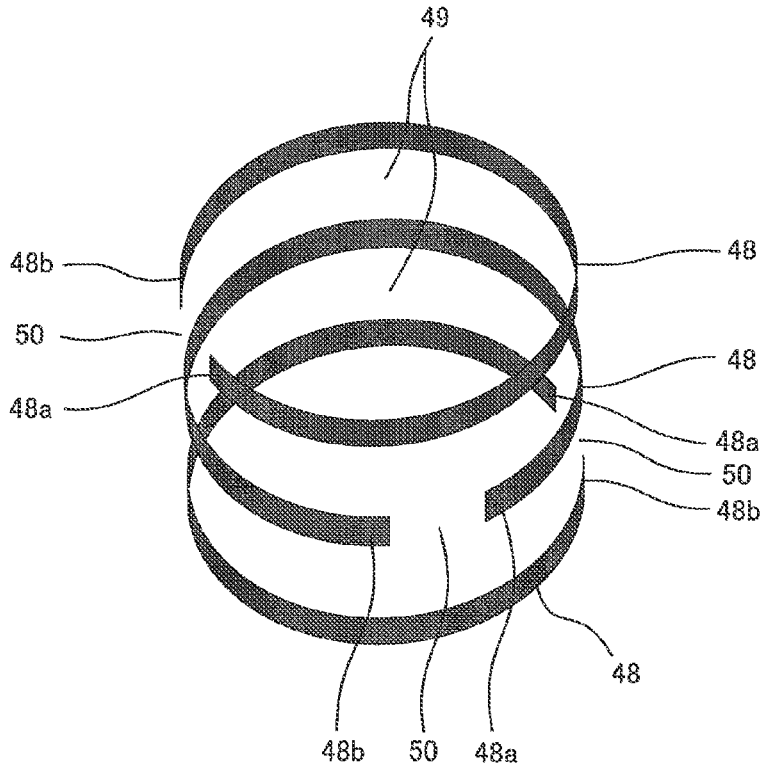
FIG. 3(*a*) is a perspective view schematically showing the quenched portion formed on each of the tilt adjustment large-diameter cylinder chamber and tilt adjustment small-diameter cylinder chamber included in the swash plate type liquid-pressure rotating device according to Embodiment 2 of the present invention.
Figure 3:
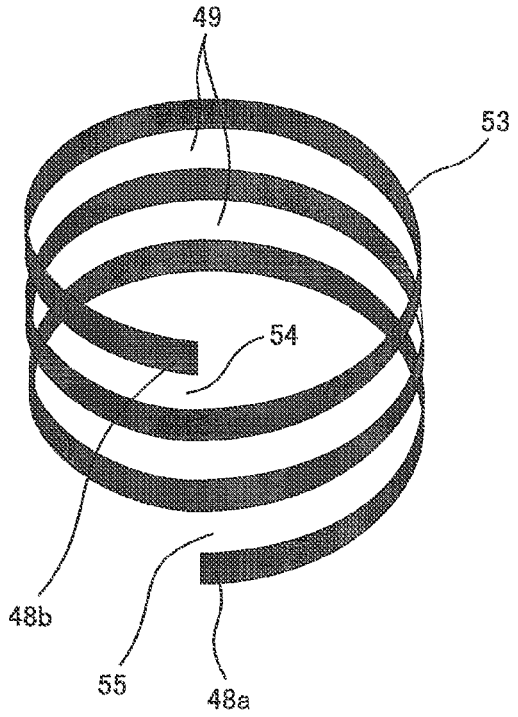

Next, Embodiment 2 of the swash plate type liquid-pressure rotating device according to the present invention will be explained in reference to FIG. 3(*a*). FIG. 3(*a*) schematically and stereoscopically shows the quenched portions 48 formed on the inner peripheral surface 42*a* of the tilt adjustment large-diameter cylinder chamber 42 and the inner peripheral surface 43*a* of the tilt adjustment small-diameter cylinder chamber 43 in Embodiment 2, and the large-diameter cylinder chamber 42 and the small-diameter cylinder chamber 43 are omitted.

A difference between the quenched portions 48 formed on the inner peripheral surface 42*a* of the tilt adjustment large-diameter cylinder chamber 42 and the inner peripheral surface 43*a* of the tilt adjustment small-diameter cylinder chamber 43 in Embodiment 2 shown in FIG. 3(*a*) and the quenched portions 48 formed on the inner peripheral surface 42*a* of the tilt adjustment large-diameter cylinder chamber 42 and the inner peripheral surface 43*a* of the tilt adjustment small-diameter cylinder chamber 43 in Embodiment 1 shown in FIGS. 2(*a*) and 2(*b*) is that the arrangement of the pattern of the quenched portions 48 is changed. Other than this difference, these quenched portions 48 are the same as each other, so that explanations thereof are omitted.

To be specific, the gaps 50 of the adjacent annular quenched portions 48 in Embodiment 2 shown in FIG. 3(*a*) are separated from each other at about 90° in the circumferential direction of the quenched portion 48. With this, the leakage distance of the lubricating oil and the hydraulic oil can be comparatively increased, so that the lubricating oil and the hydraulic oil can be prevented from leaking.

Next, Embodiment 3 of the swash plate type liquid-pressure rotating device according to the present invention will be explained in reference to FIG. 3(*b*). FIG. 3(*b*) schematically and stereoscopically shows a quenched portion 53 formed on each of the inner peripheral surface 42*a* of the tilt adjustment large-diameter cylinder chamber 42 and the inner peripheral surface 43*a* of the tilt adjustment small-diameter cylinder chamber 43 in Embodiment 3, and the large-diameter cylinder chamber 42 and the small-diameter cylinder chamber 43 are omitted.

A difference between the quenched portion 53 formed on each of the inner peripheral surface 42*a* of the tilt adjustment large-diameter cylinder chamber 42 and the inner peripheral surface 43*a* of the tilt adjustment small-diameter cylinder chamber 43 in Embodiment 3 shown in FIG. 3(*b*) and the quenched portions 48 formed on the inner peripheral surface 42*a* of the tilt adjustment large-diameter cylinder chamber 42 and the inner peripheral surface 43*a* of the tilt adjustment small-diameter cylinder chamber 43 in Embodiment 1 shown in FIGS. 2(*a*) and 2(*b*) is that the shape of the pattern of the quenched portion is changed. Other than this difference, the quenched portions 53 and 48 are the same as each other, so that explanations thereof are omitted.

To be specific, the quenched portion 53 in Embodiment 3 shown in FIG. 3(*b*) is formed in a spiral shape about the shaft center of each of the large-diameter cylinder chamber 42 and the small-diameter cylinder chamber 43. Each of a horizontal width of a circular portion of the spiral quenched portion 53 and an interval (that is, a horizontal width of the non-quenched portion 49) between the adjacent circular portions is set to such a size that does not reduce the effect of the quenching of the quenched portion 53 or is set to a size larger than the above size.

By forming the quenched portion 53 in the spiral shape, a time in which the quenching by the laser light can be continuously carried out can be increased more than in Embodiment 1, so that the quenching can be efficiently carried out. Then, the lubricating oil can be stored in a spiral groove portion that is the non-quenched portion 49 formed between the quenched portions 53. Further, since a distance between both end openings 54 and 55 of the spiral groove portion can be increased, an oil leakage distance can be comparatively increased.

Then, the interval between the adjacent circular portions of the spiral quenched portion 53 is set to such a size that does not reduce the effect of the quenching or is set to a size larger than the above size, so that the practical effect of the quenching can be obtained.

Next, FIG. 4 will be explained. FIG. 4 is a diagram showing results of an endurance test of an entrance upper portion on the inner peripheral surface 43*a* of the tilt adjustment small-diameter cylinder chamber 43 according to Embodiment 1 shown in FIG. 2(*b*). In FIG. 4, "●" denotes a test result in a case where the inner peripheral surface 43*a* is not subjected to a hardening treatment (standard), "■" denotes a test result in a case where the inner peripheral surface 43*a* is subjected to the gas nitrocarburizing, and "◆" denotes a test result in a case where the inner peripheral surface 43*a* is subjected to the laser quenching (area ratio: 60%). In FIG. 4, a vertical axis denotes an abrasion amount δ (μ m), and a horizontal axis denotes the number of times N ($\times 10^4$) the tilt adjustment small-diameter piston 45 changes its direction by sliding.

Moreover, the material of the tilt adjustment small-diameter cylinder chamber used in these endurance tests is cast iron (FCV420). The thickness of a hardened layer of the quenched portion formed by the gas nitrocarburizing is 0.1 to 0.2 mm, and the thickness of a hardened layer of the quenched portion formed by the laser quenching is 0.2 to 0.3 mm.

Figure 4:
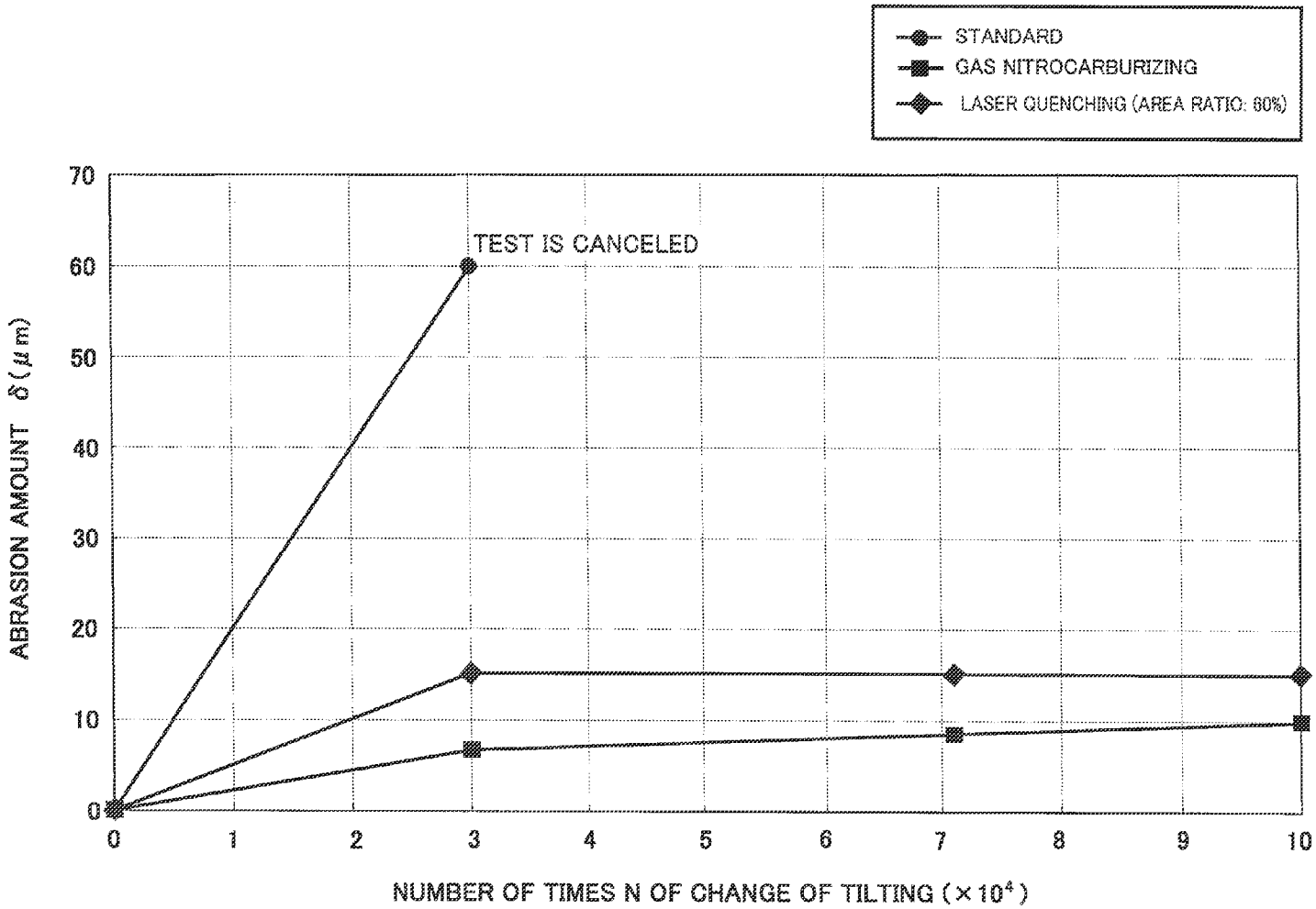
FIG. 4 is a diagram showing results of an endurance test of the tilt adjustment small-diameter cylinder chamber included in the swash plate type liquid-pressure rotating device according to Embodiment 1.

As is clear from FIG. 4, the inner peripheral surface 43*a* subjected to the laser quenching, shown by "◆", has substantially the same abrasion resistance as the inner peripheral surface 43*a* subjected to the gas nitrocarburizing, shown by "■". It is clear that the inner peripheral surface 43*a* subjected to the laser quenching, shown by "◆", excels in the abrasion resistance as compared to the inner peripheral surface 43*a* subjected to the hardening treatment (standard), shown by "●".

In Embodiments 1 and 2, as shown in FIGS. 2(*a*) and 2(*b*) for example, one gap 50 is formed for one quenched portion 48. However, two or more gaps 50 may be formed for one quenched portion 48.

In Embodiments 1 and 2, as shown in FIGS. 2(*a*) and 2(*b*) for example, the gap 50 of one of the adjacent annular quenched portions 48 and the gap 50 of the other quenched portion 48 are formed to be separated from each other at about 180° or 90° in the circumferential direction of the quenched portion 48. However, the angle may be the other angle.

It is preferable that the angle at which the gaps 50 are separated from each other in the circumferential direction be about 90° or larger. With this, the leakage distance of the lubricating oil and the hydraulic oil can be comparatively increased.

Further, in the above embodiments, as shown in FIGS. 2(*a*) and 2(*b*) for example, the area ratio of each of the quenched portions 48 and 53 is set to about 60%. However, the area ratio may be the other ratio. For example, in order to secure the seizing resistance and the abrasion resistance, the area ratio needs to be 50% or higher and is preferably 60% to 90%.

Here, the area ratio denotes each of a ratio of the area of the quenched portions 48 to the area of the sliding surface of the inner peripheral surface 42*a* of the large-diameter cylinder chamber 42, the sliding surface being a surface on which the large-diameter piston 44 slides, and a ratio of the area of the quenched portions 48 to the area of the sliding surface of the inner peripheral surface 43*a* of the small-diameter cylinder chamber 43, the sliding surface being a surface on which the small-diameter piston 45 slides.

INDUSTRICAL APPLICABILITY

As above, the swash plate type liquid-pressure rotating device of the present invention has an excellent effect of improving the productivity and increasing the seizing resistance and abrasion resistance of the sliding surface of the tilt adjustment cylinder and is suitable for use as such swash plate type liquid-pressure rotating device.

The invention claimed is:

1. A swash plate type liquid-pressure rotating device in which:

a plurality of pistons are arranged in a circumferential direction in a cylinder block configured to rotate with a rotating shaft; tip end portions of the pistons slide along a surface of a swash plate and the pistons reciprocate; the swash plate is supported by a swash plate supporting portion so as to be able to tilt with respect to the rotating shaft; and a tilt adjustment driving portion configured to change a tilt angle of the swash plate is included, wherein:

the tilt adjustment driving portion includes a tilt adjustment cylinder and a tilt adjustment piston configured to slide in the tilt adjustment cylinder to change the tilt angle of the swash plate;

a sliding surface of an inner surface of the tilt adjustment cylinder includes a plurality of quenched portions each formed by partially quenching the sliding surface using self-quenching during laser heat treatment, the sliding surface being a surface on which the tilt adjustment piston slides, the plurality of quenched portions being arranged in a direction along a shaft center of the tilt adjustment cylinder at predetermined intervals;

each of the quenched portions is formed in an annular shape about the shaft center of the tilt adjustment cylinder, and a gap in the annular shape which is not subjected to quenching is formed at a part of a circumference of each quenched portion; and wherein a first and second of the quenched portions are adjacent to each other in the direction along the shaft center, and the gap of the first quenched portion and the gap of the second quenched portion are offset from each other.

2. The swash plate type liquid-pressure rotating device according to claim 1, wherein a size of the gap formed at each quenched portion is set to such a size that does not reduce an effect of the quenching of each of end portions of each quenched portion or is set to a size larger than the above size, the end portions being opposed to each other with the gap therebetween.

3. The swash plate type liquid-pressure rotating device according to claim 1, wherein a non-quenched portion existing between adjacent quenched portions forms an annular groove portion.

4. The swash plate type liquid-pressure rotating device according to claim 1, wherein an area ratio of the quenched portions with respect to the sliding surface of an inner surface of the tilt adjustment cylinder is 50% to 90%, the sliding surface being a surface on which the tilt adjustment piston slides.

5. The swash plate type liquid-pressure rotating device according to claim 1, used as a motor or a pump.

* * * * *